US010434353B1

(12) United States Patent
Fabbri

(10) Patent No.: US 10,434,353 B1
(45) Date of Patent: Oct. 8, 2019

(54) PORTABLE EXERCISE BALL-AND-STICK APPARATUS

(71) Applicant: Thomas S. Fabbri, Port Jefferson, NY (US)

(72) Inventor: Thomas S. Fabbri, Port Jefferson, NY (US)

( * ) Notice: Subject to any disclaimer, the term of this patent is extended or adjusted under 35 U.S.C. 154(b) by 0 days.

(21) Appl. No.: 15/795,034

(22) Filed: Oct. 26, 2017

(51) Int. Cl.
*A63B 21/00* (2006.01)
*A63B 21/06* (2006.01)

(52) U.S. Cl.
CPC .... *A63B 21/00185* (2013.01); *A63B 21/0615* (2013.01); *A63B 21/4035* (2015.10); *A63B 21/4043* (2015.10); *A63B 21/4049* (2015.10); *A63B 2209/00* (2013.01); *A63B 2210/50* (2013.01)

(58) Field of Classification Search
CPC ..... A63B 21/018; A63B 21/40; A63B 21/06; A63B 2209/10; A63B 2210/50
See application file for complete search history.

(56) References Cited

U.S. PATENT DOCUMENTS 605,747 A * 6/1898 Sachs et al. ..... A63B 21/0615 482/97
2,817,524 A * 12/1957 Sadler ..... A63B 23/12 482/117
2,909,371 A * 10/1959 Alcover ..... A63B 23/00 482/148
3,428,311 A * 2/1969 Mitchell ..... A63B 21/015 482/130
3,587,319 A * 6/1971 Andrews ..... A63B 21/0083 482/112
3,737,938 A * 6/1973 Saltzstein ..... A47L 13/256 15/231
4,060,241 A * 11/1977 Hegel ..... A63B 21/015 482/60
4,066,231 A * 1/1978 Bahner ..... B43M 99/00 248/289.11
4,139,193 A * 2/1979 Felber ..... A63B 69/004 482/90
4,222,680 A * 9/1980 Browning ..... A45B 17/00 403/133
4,249,727 A * 2/1981 Dehan ..... A63B 21/015 482/117

(Continued)

*Primary Examiner* — Garrett K Atkinson
(74) *Attorney, Agent, or Firm* — Edwin D. Schindler

(57) ABSTRACT

A portable exercise ball-and-stick apparatus includes a base having an upper surface with a centrally-located concave spherical region located within the upper surface, a ball able to be located in the centrally-located concave spherical region of the base and a rod affixed to the ball for freely moving the ball within the centrally-located concave spherical region of the base. Preferably, the includes an additional concave spherical region having a spike centrally located in the additional concave spherical region with the spike extending vertically from a central region of the additional concave spherical region for receiving in a complementary slot situated longitudinally and on a side of the opposite from which the rod extends from said ball for when the exercise apparatus is not being used. Preferably, the rod includes a hand grip at the end of the rod distal to the ball with the hand grip being able to rotate or swivel relative to the rod.

8 Claims, 6 Drawing Sheets

(56) References Cited

U.S. PATENT DOCUMENTS

| | | | | | |
|---|---|---|---|---|---|
| 5,071,279 | A * | 12/1991 | Rutstrom | F16M 11/14 | 403/114 |
| 5,244,444 | A * | 9/1993 | Wostry | A63B 21/0615 | 482/109 |
| D384,710 | S * | 10/1997 | Pahel | D21/694 | |
| 5,971,891 | A * | 10/1999 | Humphrey | A63B 69/0022 | 482/51 |
| 6,588,045 | B2 * | 7/2003 | Fernandez | A47L 13/144 | 15/116.1 |
| 7,090,626 | B1 * | 8/2006 | Miller | A63B 21/4035 | 482/139 |
| 7,115,078 | B1 * | 10/2006 | Kalember | A63B 21/015 | 482/117 |
| 7,404,227 | B2 * | 7/2008 | Otsuka | A47L 13/20 | 15/208 |
| RE43,806 | E * | 11/2012 | Carnevali | F16M 11/14 | 248/181.1 |
| 8,317,668 | B2 * | 11/2012 | Sales | A63B 21/04 | 482/140 |
| 8,636,630 | B2 * | 1/2014 | Morris | A63B 21/00069 | 482/117 |
| 8,900,009 | B2 * | 12/2014 | Hornick | H01R 13/73 | 248/288.51 |
| 8,915,828 | B1 * | 12/2014 | Stalnaker | A63B 21/00185 | 482/117 |
| 2003/0013586 | A1 * | 1/2003 | Rothschild | A63B 23/12 | 482/117 |
| 2005/0132519 | A1 * | 6/2005 | Chen | A47L 13/12 | 15/121 |
| 2009/0048043 | A1 * | 2/2009 | Lamson | A63B 60/10 | 473/513 |
| 2018/0099186 | A1 * | 4/2018 | Boysen | A63B 26/003 | |

* cited by examiner

PORTABLE EXERCISE BALL-AND-STICK APPARATUS

BACKGROUND OF THE INVENTION

Technical Field of the Invention

The present invention relates, generally, to a portable exercise apparatus which may readily be used in a home or office environment for either brief periods of exercise or for more sustained exercise sessions.

More particularly, the present invention relates to a portable exercise apparatus comprising a base having a partial and concave spherical region for accepting therein a ball and with a rod-portion extending from the ball, which may be either linearly- or non-linearly-shaped, and preferably with a handle at the end of the rod distal from the ball for gripping the rod. The rod (whether linear or non-linear) is preferably made of a metal, preferably iron or steel of sufficiently density for providing considerable weight to the rod. The handle at the end of the rod distal from the ball is preferably made to be rotatable vis-à-vis the rod for allowing a user to rotate and otherwise manipulate the rod without having to alter the user's original grip of the handle.

Description of the Prior Art

Generally, it is known that there are numerous exercise devices for home use or use outside of a formal gymnasium setting, including "use at home" weight-lifting devices, such as sets of barbells and other weight-resistant exercises. Most of these types of home use weight-resistance or weight-strengthening devices are not readily movable without great difficulty, generally requiring professional moving services.

The prior art would appear to lack an exercise apparatus that is both readily portable, yet provides for weight-resistant, or weight-bearing, exercise by its user.

SUMMARY OF THE INVENTION

It is, therefore, an object of the present invention to provide a portable exercise ball-and-stick apparatus for providing a user the opportunity for a weight-resistance or weight-bearing exercise.

It is a further object of the present invention to provide a portable exercise ball- and stick apparatus that can be readily moved from one location to another remote location by a single person without special moving equipment or assistance.

It is an additional object of the present invention to provide a portable exercise ball-and-stick apparatus which overcomes the inherent drawbacks of prior art devices, particularly those exercise devices conventionally known to the prior art and are intended to provide weight-resistance or weight-bearing exercise.

The foregoing and related objects are achieved by the present invention, which provides a portable exercise ball-and-stick apparatus, which includes a base having a partial and concave spherical region for accepting therein a ball and with a rod-portion extending from the ball, which may be either linearly- or non-linearly-shaped, and preferably with a handle at the end of the rod distal from the ball for gripping the rod with the handle preferably being rotatable relative to the rod. The rod is, preferably, made of a high-grade steel or iron, or similar metal, having sufficient weight for requiring a user to expend a reasonable measure of strength for achieving the benefits of a weight-resistance or weight-bearing exercise. By way of example, the rod, which is preferably linear, could preferably have a length of five to seven feet and weigh forty or fifty pounds. Rods of greater or lesser lengths are within the scope of the present invention and may weigh more or less than the foregoing weights. The rod preferably has a handle or hand grip at the end distal to the ball which includes an insert or extension portion that is able to be placed within a hollow portion of the distal end of the rod thereby rendering the handle rotatable vis-à-vis the rod itself. Other means for rendering the handle rotatable relative to the rod, so that a user need not be required to readjust his grip during use of the inventive apparatus, are also within the scope of the claimed invention. The ball is preferably made of high-density steel, iron or similar metal.

In use, the ball is to be freely rotatable within the partial, concave spherical region of the base, so that the user may lift the rod from either its hand grip portion or at a part of the rod that is more intermediate between the ball and the distal end of the rod preferably having the handle, thereby effectively increasing the weight that it borne by the user. The user may also "toss" the rod from one hand to the other as a manner of exercise. When in use, the ball rests within the partial, concave spherical region of the base, but is not itself attached to the base so that it (and the attached rod) is freely rotatable by the user for permitting exercise.

The base having the partial, concave spherical region for supporting the ball in a freely rotatable position may, preferably, be made of either a plastic material or a metal, such as titanium, and should be of both sufficient durability to support the weight of the ball and rod attached to the ball, yet still be of a weight that is sufficiently light for permitting the user to readily grasp and carry the base to another location. It is further preferable that the base include either a separate handle portion for more easily allowing it to be carried by a person or, in the alternative, one or more cutout portions near the perimeter of the base for use as one or more handles for readily transport by a single person.

Preferably, the rod is permanently affixed to the ball, though this is not required, and the rod may instead be removably attached to the ball, for example, by way of means of a threaded-screw connection, a snap-in connection, etc.

In a particularly preferred embodiment of the present invention, the portion of the ball is provided with an opening or slot therein, which slot is situated longitudinally and on the side of the ball opposite from which the rod extends. The base includes a further concave spherical region, not centrally located on the upper side of the base, from which a relatively short rod, or spike, extends from the central portion thereof for mating with the opening or slot within the ball. At the conclusion of a period of exercise, the user can position the rod for placing the spike of the additional concave spherical region within the longitudinal slot of the ball, which is opposite the rod used for free rotation of the ball for exercising, for allowing the ball-and-rod combination to be retained during periods of non-use.

Other objects and features of the present invention will become apparent when considered in combination with the accompanying drawing figures, which illustrate certain preferred embodiment of the present invention. It should, however, be noted that the accompanying drawing figures are intended to illustrate only select preferred embodiments of the claimed invention and are not intended as a means for defining the limits and scope of the invention.

BRIEF DESCRIPTION OF THE DRAWING FIGURES

In the drawing figures, wherein similar features are denoted with similar reference numerals throughout the several views.

Figure 6A:
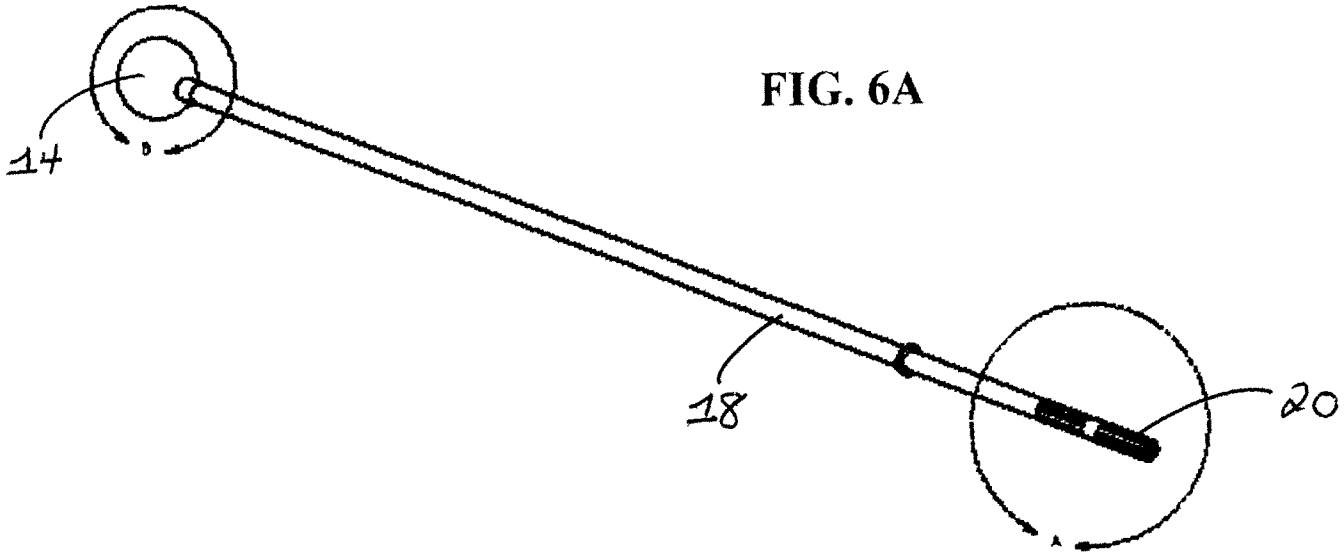
Figure 6B:
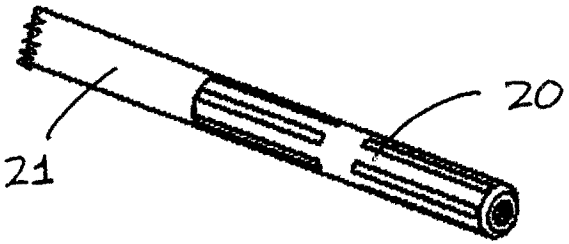

FIG. 6A is a perspective view of the ball-and-stick exercise apparatus of the present invention showing the ball-and-stick with a handle for gripping by a user at the end of the stick distal from the ball; and, FIG. 6B is a partial, exploded perspective view of the handle of the stick having an extension extending from the handling for insertion into a hollow portion of the distal end of the stick for allowing the handle or hand grip to be swiveled by a user relative to the stick.

DETAILED DESCRIPTION OF THE DRAWING FIGURES AND PREFERRED EMBODIMENTS

Figure 1:
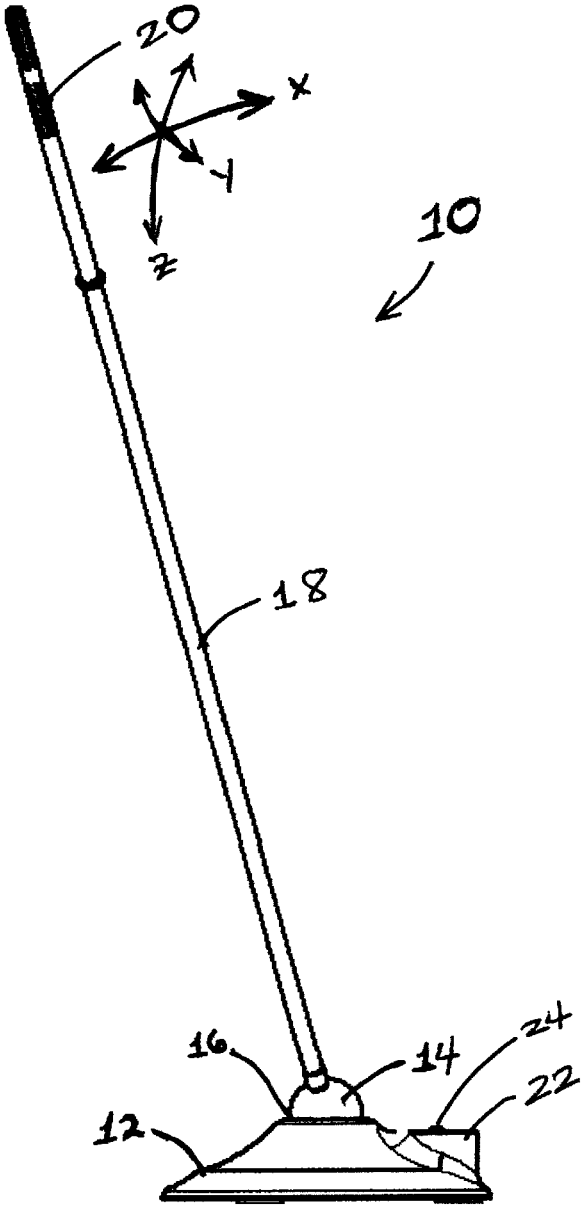
FIG. 1 is an elevational view of the portable ball-and-stick exercise apparatus of the present invention.
Figure 3:
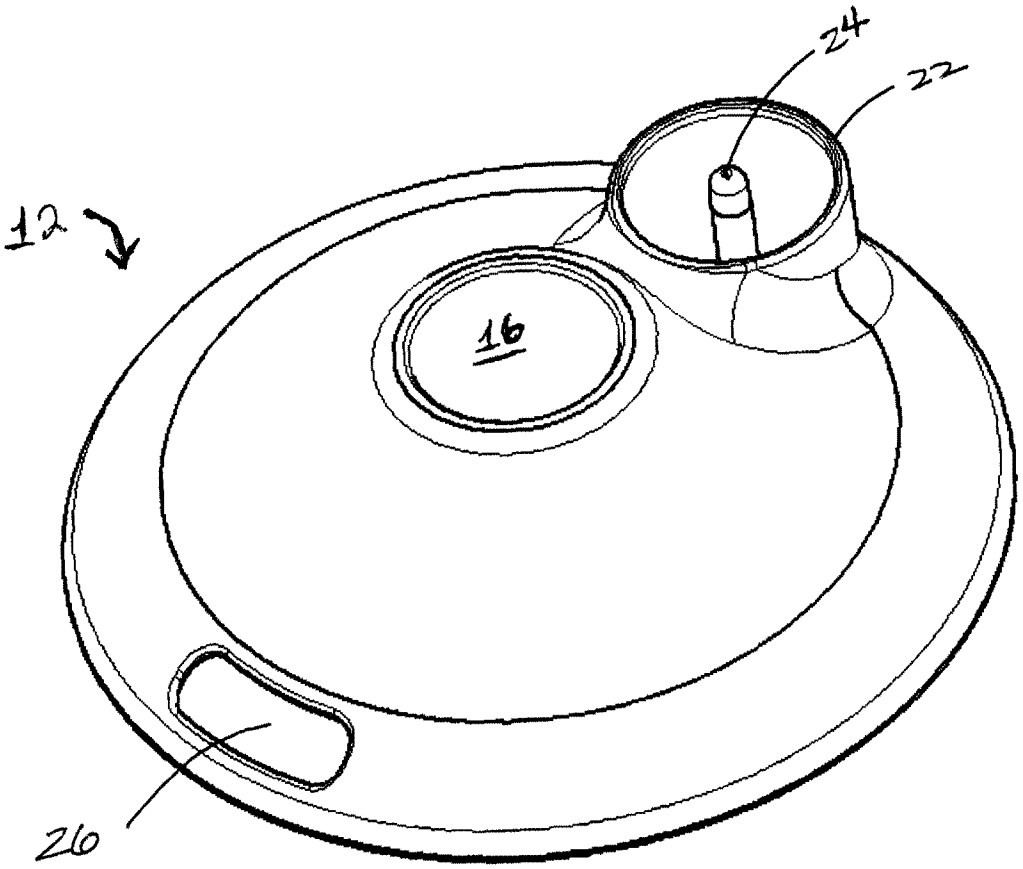
FIG. 3 is a prospective view of the base of the ball-and-stick exercise apparatus of the present invention without the ball and rod, as illustrated in FIG. 1.
Figure 4:
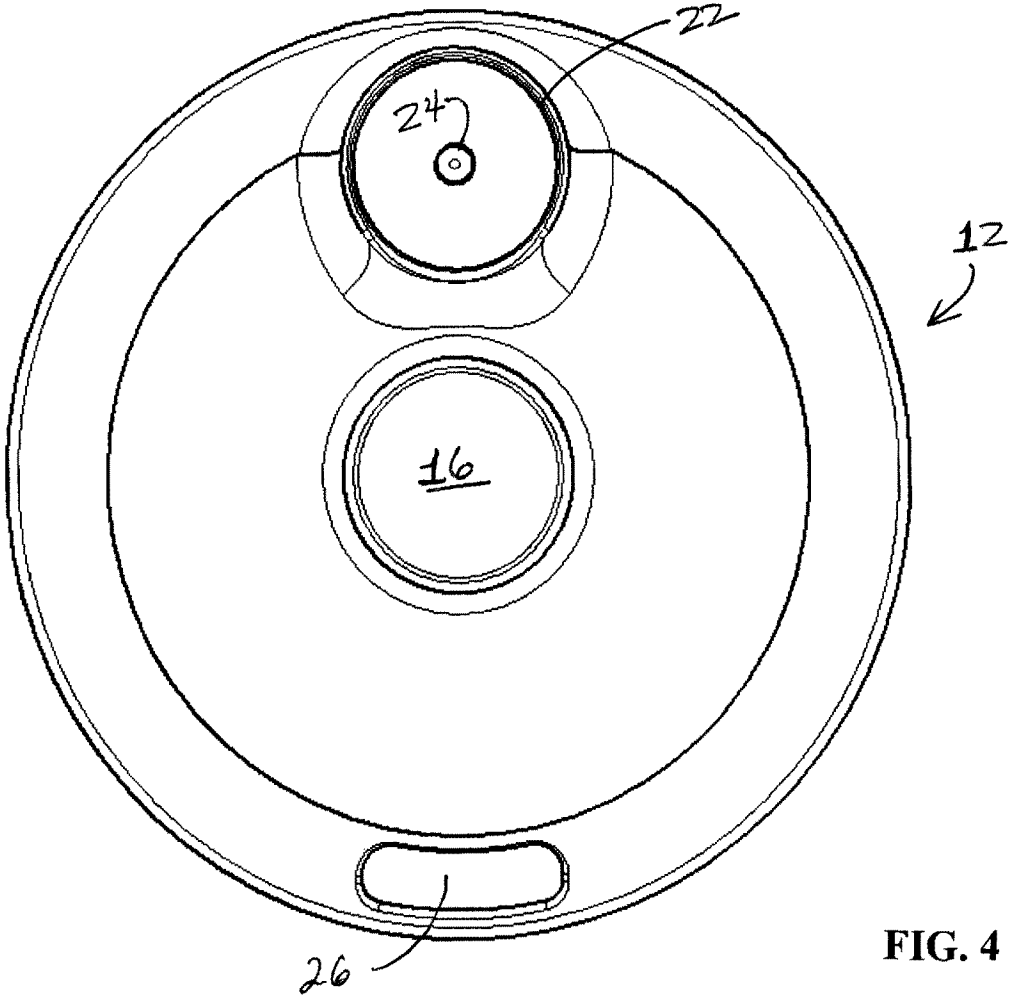
FIG. 4 is a plan view of the base of the ball-and-stick exercise apparatus of the present invention without the ball and rod, as illustrated in FIG. 3.

Turning now, in detail, to an analysis of the accompanying drawing figures, FIG. 1 presents an elevational view of the portable ball-and-rod exercise apparatus 10 of the present invention, which includes a base 12 with ball 14 located in a partial and concave spherical region 16, as best seen in FIGS. 3 and 4, with a rod or stick 18 being affixed to ball 14 and extending vertically therefrom. Rod 18 preferably includes a handle or hand grip 20 for a user to grip the upper portion of rod 18 when exercising. Ball 14 sits in the concave spherical region 16 of base 12, so that rod 18 is freely movable when seated in the concave spherical region of the base. The rod 18 is, preferably, about five to seven feet in length and weighs forty or fifty pounds, though the invention is not limited to a rod having these physical characteristics. The rod is preferably made of dense steel, iron or other metal or material of sufficient weight to provide meaningful weight resistance for exercising. A user is able to move rod 18 either from side-to-side or in any direction, without limitation, since ball 14 uninhibitedly sits within the concave spherical region 16 of the base 12.

Figure 2:
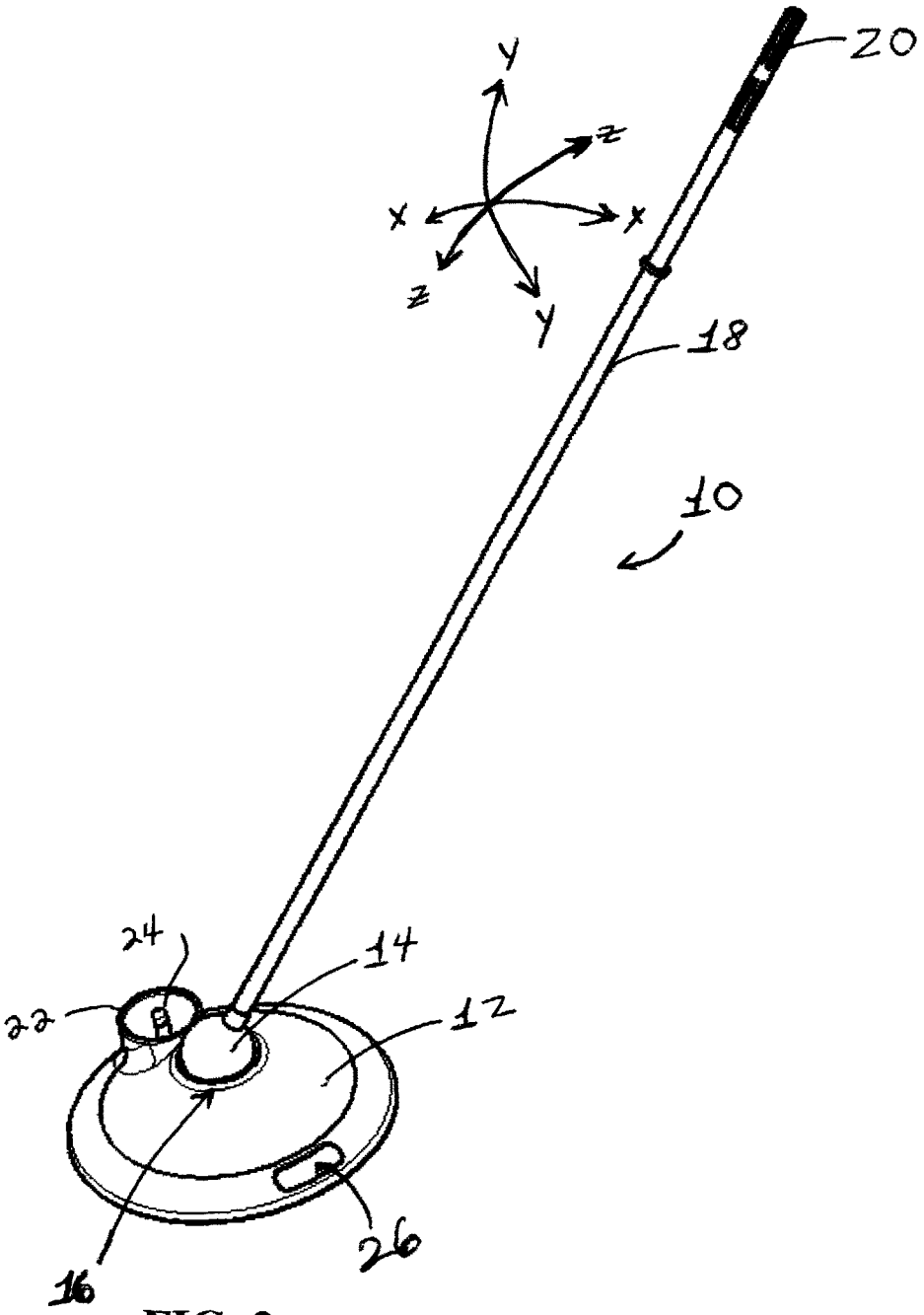
FIG. 2 is a prospective view of the portable ball-and-stick exercise apparatus of FIG. 1.
Figures 5A, 5B:
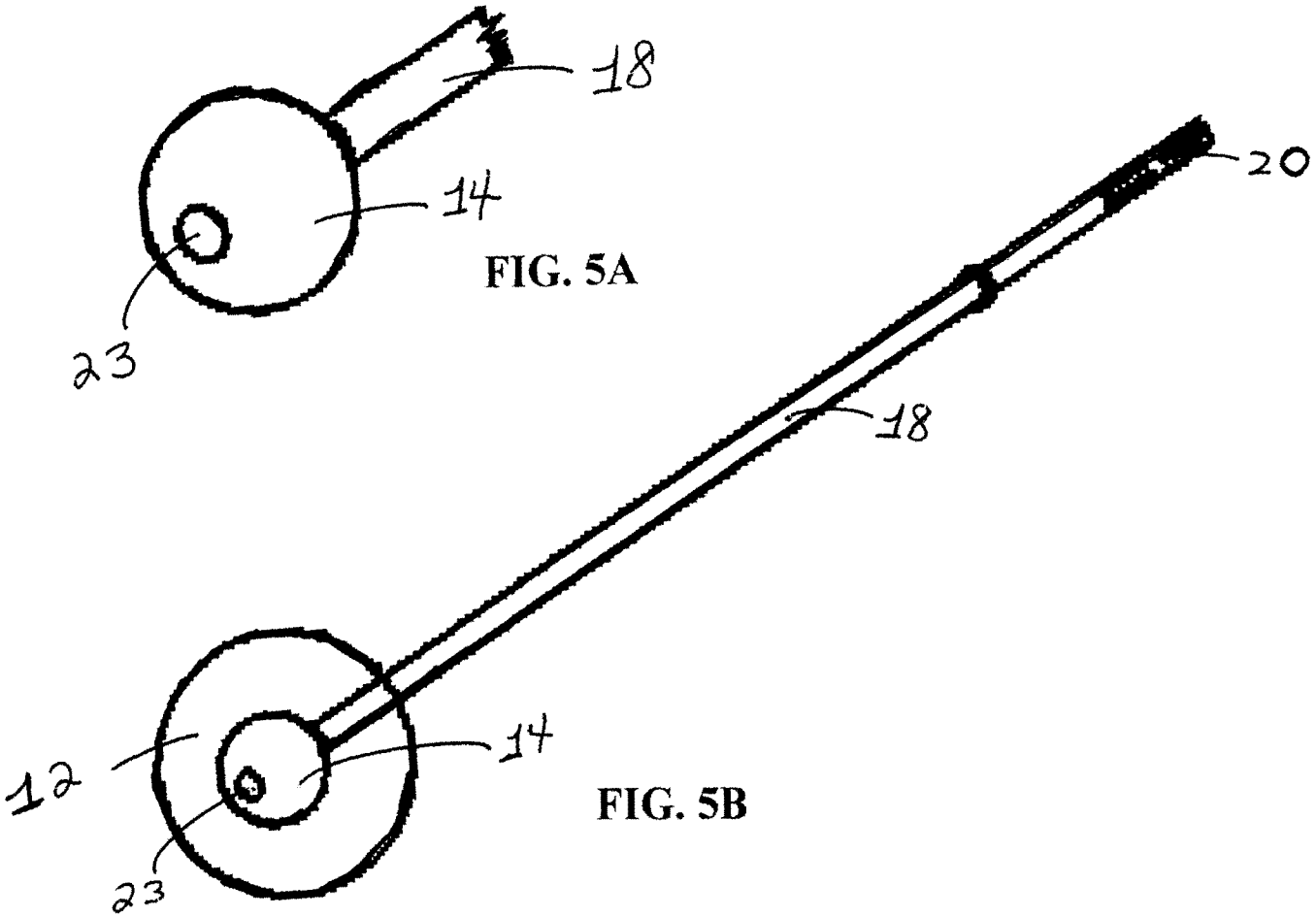
FIG. 5A is a prospective view of a portion of the stick of the ball-and-stick exercise apparatus of the present invention showing the ball with a slot in the side of the ball opposite the rod for receiving a spike for retaining the ball-and-stick when not in use.
FIG. 5B is a perspective view of the ball-and-stick exercise apparatus of the present invention showing the ball-and-stick able to be swiveled within a concave spherical portion of the base.

FIG. 2 is a prospective view of the portable ball-and-rod exercise apparatus 10 of FIG. 1 having base 12, ball 14 resting in the concave spherical region 16 of base 12 and with rod 18, having handle or hand grip 20, extending therefrom. As able to be seen in FIG. 2 is a second, off-of-center concave spherical region 22 having rod or spike 24 centrally located in spherical region 22 and extending upward therefrom. In a preferred embodiment, ball 14 is provided with an opening or slot 23 therein (as seen in FIGS. 5A and 5B), which slot 23 is situated longitudinally and on the side of the ball opposite from which the rod 18 extends. At the conclusion of a period of exercise, the user can position the rod 18 for placing the spike 24 of the additional concave spherical region 22 within the longitudinal slot 23 of the ball 14, which is opposite the rod 18 used for free rotation of the ball 14 for exercising, for allowing the ball-and-rod combination to be retained during periods of non-use.

FIGS. 3 and 4 are prospective and plan views, respectively, of base 12 without ball 14 having rod 18 seated within the central concave spherical region 16 of base 12. As able to be seen from FIGS. 2, 3 and 4, base 12 further includes a cutout 26 for use as a handle for carrying base 12 separate and apart from the rod 18 having ball 14. Various types of handles or grips 20 are conceivable and possible for readily allowing the user to carry base 14. The base may be made of any durable material, such as a plastic material or a metal.

FIG. 5A best illustrates the ball 14 having slot 23 in the side of the ball, which is longitudinally opposite the stick or rod 18, for receiving spike 24 (as best shown in FIGS. 3 and 4) for retaining the ball-and-stick combination when the user is not using the exercise apparatus.

FIG. 5B shows slot 23 of ball 14 may also be seen in FIG. 5B with the ball-and-stick combination being within the concave spherical region 16 of base 12.

FIG. 6A shows rod or stick 18 with a handle or hand grip 20 for gripping the handle by a user at the end of the stick distal from the ball 14. Preferably, the handle or hand grip 20 is able to swivel or rotate relative to stick 18, so that a user need not adjust his grip during exercise. There are many potential ways for rendering the hand grip rotatable vis-à-vis the stick or rod the present invention. One way is to provide hand grip 20 with an extension 21 (as illustrated in FIG. 6B) and is able to be placed (and retained) within a hollow portion of the distal end of stick 18, thereby permitting rotation of the hand grip vis-à-vis rod 18.

While only several embodiments of the present invention have been shown and described, it will be obvious to those skilled in the art that many modifications may be made to the present invention without departing from the spirit and scope thereof

What is claimed is:

1. A portable exercise ball-and-stick apparatus, comprising:

a base having an upper surface with a centrally-located concave spherical region located within the upper surface;

a ball locatable in the centrally-located concave spherical region of said base; and, a rod affixed to said ball for freely moving said ball within the centrally-located concave spherical region of said base, wherein said base further includes an additional concave spherical region having means for permitting retention of said ball within said additional concave spherical region when said ball is not located within said centrally-located concave spherical region, wherein said means for permitting retention of said ball within said additional concave spherical region includes a spike centrally located in said additional concave spherical region with said spike extending vertically from a central region of said additional concave spherical region for being received in a complementary slot situated longitudinally and on a side of said ball opposite from which said rod extends from said ball.

2. The portable exercise ball-and-stick apparatus according to claim 1, wherein said rod is removably affixed to said ball.

3. The portable exercise ball-and-stick apparatus according to claim 2, wherein said rod is removably affixed to said ball via a threaded-screw connection.

4. The portable exercise ball-and-stick apparatus according to claim 1, wherein said rod includes a handle or hand grip located at an end of said rod distal from said ball for gripping the rod.

5. The portable exercise ball-and-stick apparatus according to claim 4, wherein said handle or said hand grip of said rod includes means for rendering said handle or said hand grip rotatable relative to said rod.

6. A portable exercise ball-and-stick apparatus, comprising:

a base having an upper surface with a centrally-located concave spherical region located within the upper surface;

a ball locatable in the centrally-located concave spherical region of said base;

a rod affixed to said ball for freely moving said ball within the centrally-located concave spherical region of said base; and, a handle or hand grip coaxially located and surrounding an end of said rod distal from said ball for gripping said rod, said handle or hand grip permitting a user of said portable exercise ball-and-stick apparatus to simultaneously grip said handle or hand grip and encircle said rod with a single hand, wherein said base further includes an additional concave spherical region having means for permitting retention of said ball within said additional concave spherical region when said ball is not located within said centrally-located concave spherical region, wherein said means for permitting retention of said ball within said additional concave spherical region includes a spike centrally located in said additional concave spherical region with said spike extending vertically from a central region of said additional concave spherical region for being received in a complementary slot situated longitudinally and on a side of said ball opposite from which said rod extends from said ball.

7. The portable exercise ball-and-stick apparatus according to claim 6, wherein said rod is removably affixed to said ball.

8. The portable exercise ball-and-stick apparatus according to claim 7, wherein said rod is removably affixed to said ball via a threaded-screw connection.

* * * * *